US008944083B2

(12) United States Patent
Collier et al.

(10) Patent No.: US 8,944,083 B2
(45) Date of Patent: Feb. 3, 2015

(54) GENERATION OF MONODISPERSE DROPLETS BY SHAPE-INDUCED SHEAR AND INTERFACIAL CONTROLLED FUSION OF INDIVIDUAL DROPLETS ON-DEMAND

(75) Inventors: Charles Patrick Collier, Oak Ridge, TN (US); Scott T. Retterer, Knoxville, TN (US); Seung-Yong Jung, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 427 days.

(21) Appl. No.: 13/161,080

(22) Filed: Jun. 15, 2011

(65) Prior Publication Data

US 2012/0322162 A1 Dec. 20, 2012

(51) Int. Cl.

| | |
|---|---|
| ***E03B 1/00*** | (2006.01) |
| ***B01F 3/08*** | (2006.01) |
| ***B01L 3/00*** | (2006.01) |
| ***B01F 13/00*** | (2006.01) |
| ***B01F 15/02*** | (2006.01) |
| *B01L 3/02* | (2006.01) |

(52) U.S. Cl.

CPC ..... *B01F 3/0807* (2013.01); *B01L 3/502784* (2013.01); *B01F 13/0071* (2013.01); *B01F 15/0241* (2013.01); *B01L 3/0268* (2013.01); *B01L 2200/0673* (2013.01); *B01L 2300/0816* (2013.01); *B01L 2300/0867* (2013.01); *B01L 2400/02* (2013.01); *B01L 2400/0406* (2013.01)

USPC ..... 137/3; 137/825; 137/827; 137/832; 137/833; 436/172

(58) Field of Classification Search

None

See application file for complete search history.

(56) References Cited

U.S. PATENT DOCUMENTS

| | | | |
|---|---|---|---|
| 7,595,195 | B2 | 9/2009 | Lee et al. |
| 2006/0079585 | A1 | 4/2006 | Higuchi et al. |

(Continued)

FOREIGN PATENT DOCUMENTS

| | | | |
|---|---|---|---|
| CA | 2636855 | A1 | 6/2006 |
| WO | 2009119578 | A1 | 10/2009 |

OTHER PUBLICATIONS

He, M, et al., "Effects of Ultrasmall Orifices on the Electrogeneration of Femtoliter-Volume Aqueous Droplets", Langmuir, Jul. 2006, 22, pp. 6408-6413.

(Continued)

*Primary Examiner* — Robert Xu

(74) *Attorney, Agent, or Firm* — Scully, Scott, Murphy & Presser, P.C.

(57) ABSTRACT

A microfluidic device for generation of monodisperse droplets and initiating a chemical reaction is provided. The microfluidic device includes a first input microchannel having a first dimension and including a first phase located therein. The device also includes a second input microchannel having a second dimension and including a second phase located therein. In accordance with the present disclosure, the second dimension is different from the first dimension and the first phase is immiscible in the second phase. A microchannel junction is also present and is in communication with the first input microchannel and the second input microchannel. The device further includes an output channel in communication with the microchannel junction and set to receive a monodisperse droplet. In the present disclosure, the difference in the first dimension and the second dimension creates an interfacial tension induced force at the microchannel junction which forms the monodisperse droplet.

9 Claims, 9 Drawing Sheets

(56) References Cited

U.S. PATENT DOCUMENTS

| | | | |
|---|---|---|---|
| 2007/0264320 | A1 | 11/2007 | Lee et al. |
| 2008/0074449 | A1 | 3/2008 | Lee et al. |
| 2009/0053174 | A1 | 2/2009 | Kaneko et al. |
| 2009/0235990 | A1 | 9/2009 | Beer |

OTHER PUBLICATIONS

Fair, R.B., "Digital microfluidics: is a true lab-on-a-chip possible?", Microfluid Nanofluid, 2007, vol. 3, pp. 245-281.
Gascoyne, P.R.C., et al., "Dielectrophoresis-based programmable fluidic processors", Lab Chip, Aug. 2004, vol. 4, pp. 299-309.
Shim, J., et al., "Control and Measurement of the Phase Behavior of Aqueous Solutions Using Microfluidics", J. Am. Chem. Soc., Jul. 2007, vol. 129, pp. 8825-8835.
Boukellal, S., et al, "Simple, robust storage of drops and fluids in a microfluidic device", Lab Chip, Jan. 2009, vol. 9, pp. 331-338.
Kobayashi, M., et al., "Silicon Array of Elongated Through-Holes for Monodisperse Emulsion Droplets", AIChE Journal, Aug. 2002, vol. 48, No. 8, pp. 1639-1644.
Sugiura, M., et al., "Interfacial Tension Driven Monodispersed Droplet Formation from Microfabricated Channel Array", Langmuir, Aug. 2001, vol. 17, pp. 5562-5566.
Delamarche, A., et al., "Microfluidic Networks for Chemical Patterning of Substrates: Design and Application to Bioassays", J. Am. Chem. Soc., Jan. 1998, vol. 120, pp. 500-508.
Geerken, M.J., et al., "Interfacial aspects of water drop formation at micro-engineered orifices", J. Colloid Interface Sci., Aug. 2007, vol. 312, pp. 460-469.
Huang, H., et al., "Coating of poly(dimethylsiloxane) with n-dodecyl-b-D-maltoside to minimize nonspecific protein adsorption", Lab Chip, Sep. 2005, vol. 5, pp. 1005-1007.
Schmid,H., et al., "Siloxane Polymers for High-Resolution, High-Accuracy Soft Lithography", Mar. 2000, vol. 33, pp. 3042-3049.
Tan, Y., et al., "Monodispersed microfluidic droplet generation by shear focusing microfluidic device", Sensors and Actuators B: Chemical, Mar. 2006, vol. 114, No. 1, pp. 350-356.
Xu, J.H., et al., "Shear force induced monodisperse droplet formation in a microfluidic device by controlling wetting properties", Nov. 2006, vol. 6, pp. 131-136.
Okamoto, K., et al., "Shape recovery of a dispersed droplet phase and stress relaxation after application of step shear strains in a polystyrene/polycarbonate blend melt", J. Rheol. Jul. 1999, vol. 43, pp. 951.
Cristini, V. et al., "Scalings for Droplet Sizes in Shear-Driven Breakup: Non-Microfluidic Ways to Monodisperse Emulsions", FDMP, 2006, vol. 2, No. 2, pp. 77-93.
Teh, S., et al., "Droplet microfluidics", Lab Chip, Feb. 2008, Epub Jan. 11, 2008, pp. 198-220.
Song, H., et al., "Reactions in Droplets in Microfluidic Channels", Angew. Chem. Int. Ed., Nov. 2006, vol. 45, pp. 7336-7356.
Chiu, D., et al., "Chemistry and Biology in Femtoliter and Picoliter Volume Droplets", Accounts of Chemical Research, May 2009, vol. 42, No. 5, pp. 649-658.
Chiu, D., et al., "Droplets for Ultrasmall-Volume Analysis", Anal. Chem., Jul. 2009, vol. 81, No. 13, pp. 5111-5118.
Schaerli, Y., et al., "The potential of microfluidic water-in-oil droplets in experimental biology", Mol. BioSyst, Dec. 2009, Epub Oct. 2009, pp. 1392-1404.
Gorris, H. H., et al., "Analytical Chemistry on the Femtoliter Scale", Angew. Chem. Int. Ed., May 2010, vol. 49, pp. 3880-3895.
Lorenz, R.M., et al., "Microfluidic and Optical Systems for the On-Demand Generation and Manipulation of Single Femtoliter-Volume Aqueous Droplets", Anal. Chem. Sep. 2006, vol. 78, No. 18, pp. 6433-6439.
Xu, J., et al., "Drop on demand in a microfluidic chip", J. Micromech. Microeng., May 2008, vol. 18, 065020.
Holden, M. A., et al., "Functional Bionetworks from Nanoliter Water Droplets", J. Am. Chem. Soc., Jun. 2007, vol. 129, pp. 8650-8655.
Hwang, W. L., et al., "Asymmetric Droplet Interface Bilayers", J. Am. Chem. Soc., May 2008, vol. 130, pp. 5878-5879.
Tang, J., et al., "Green Fluorescent Protein in Inertially Injected Aqueous Nanodroplets", Langmuir, Jan. 2008, vol. 24, pp. 4975-4978.
Tang, J., et al., "Generation and Mixing of Subfemtoliter Aqueous Droplets on Demand", Anal. Chem. Oct. 2009, vol. 81, No. 19, pp. 8041-8047.
Goldner, L. S., et al., "Droplet Confinement and Fluorescence Measurement of Single Molecules", Methods in Enzymology, Jun. 2010, vol. 472, Ch. 5, pp. 61-88.
Ahn, K., et al., "Electrocoalescence of drops synchronized by size-dependent flow in microfluidic channels", Applied Physics Letters, Jun. 2006, vol. 88, 264105.
Zagnoni, M., et al., "On-chip electrocoalescence of microdroplets as a function of voltage, frequency and droplet size", Lab Chip, Sep. 2009, vol. 9, pp. 2652-2658.
Zeng, S., et al., "Microvalve-actuated precise control of individual droplets in microfluidic devices", Lab Chip, Mar. 2009, vol. 9, pp. 1340-1343.
Wang, W., et al., "Efficient On-Demand Compound Droplet Formation: From Microfluidics to Microdroplets as Miniaturized Laboratories", Small, May 2009, vol. 5, No. 10, pp. 1149-1152.
Fidalgo, L. M., et al., "From Microdroplets to Microfluidics: Selective Emulsion Separation in Microfluidic Devices", Angew. Chem. Int. Ed., Feb. 2008, vol. 47, Issue 11, pp. 2042-2045.
Wang, W., et al., "On-demand microfluidic droplet trapping and fusion for on-chip static droplet assays", Lab Chip, Jun. 2009, vol. 9, pp. 1504-1506.
Link, D. R., et al., "Electric Control of Droplets in Microfluidic Devices", Angew. Chem. Int. Ed., Apr. 2006, vol. 45, pp. 2556-2560.
Mazutis, L., et al., "Multi-step microfluidic droplet processing: kinetic analysis of an in vitro translated enzyme", Lab Chip, Oct. 2009, vol. 9, pp. 2902-2908.
Wang, W., et al., "On-demand droplet release for droplet-based microfluidic system", Lab Chip, Mar. 2010, vol. 10, pp. 559-562.
Skelly, A. M., et al., "Microfluidic control of cell pairing and fusion", Nature Methods, Feb. 2009, vol. 6, No. 2, pp. 147-152.
Sivasamy, J., et al., "Reliable addition of reagents into microfluidic droplets", Microfluid Nanofluid, Mar. 2010, vol. 8, pp. 409-416.
Hong, J., et al., "Interfacial Tension- Meditated Droplet Fusion in Rectangular Microchannels", Biochip Journal, Sep. 2009, vol. 3, No. 3, pp. 203-207.
Hong, J., et al., "Passive self-synchronized two-droplet generation", Lab Chip, Oct. 2010, vol. 10, pp. 2702-2709.
Hung, L. H., et al., "Alternating droplet generation and controlled dynamic droplet fusion in microfluidic device for CdS nanoparticle synthesis", Lab Chip, Feb. 2006, vol. 6, pp. 174-178.
Tan, Y., et al., "Design of microfluidic channel geometries for the control of droplet volume, chemical concentration, and sorting", Lab Chip, Aug. 2004, vol. 4, pp. 292-298.
Teshima, T., et al., "A dynamic microarray device for paired bead-based analysis", Lab Chip, Sep. 2010, vol. 10, pp. 2443-2448.
Bai, Y., et al., "A double droplet trap system for studying mass transport across a droplet-droplet interface", Lab Chip, May 2010, vol. 10, pp. 1281-1285.
Fidalgo, L. M., et al., "Surface-induced droplet fusion in microfluidic devices", Lab Chip, Aug. 2007, vol. 7, pp. 984-986.
Mazutis, L., et al., "A fast and efficient microfluidic system for highly selective one-to-one droplet fusion", Lab Chip, Sep. 2009, vol. 9, pp. 2665-2672.
Niu, X., et al., "Pillar-induced droplet merging in microfluidic circuits", Lab Chip, Nov. 2008, vol. 8, pp. 1837-1841.
Priest, C., et al., "Generation of monodisperse gel emulsions in a microfluidic device", Applied Physics Letters, Jan. 2006, vol. 88, 024106.
Jin, B. J. et al. "Droplet merging in a straight microchannel using droplet size or viscosity difference", J. Micromech. . Microeng, Mar. 2010, vol. 20, pp. 035003.
Chen, D., et al., "The chemistrode: A droplet-based microfluidic device for stimulation and recording with high temporal, spatial, and chemical resolution", PNAS, Nov. 2008, vol. 105, No. 44, pp. 16843-16848.

(56) References Cited

OTHER PUBLICATIONS

Liu, Y., et al., "Dynamics of Coalescence of Plugs with a Hydrophilic Wetting Layer Induced by Flow in a Microfluidic Chemistrode", Langmuir, Mar. 2009, vol. 25, pp. 2854-2859.
Cohen, D. E., et al., "Self-Digitization of Sample Volumes", Anal. Chem., Jul. 2010, vol. 82., No. 13, 5707-5717.
Jung, S. Y., et al., "Interfacial tension controlled fusion of individual femtolitre droplets and triggering of confined chemical reactions on demand", Lab Chip, Dec. 2010, vol. 10, pp. 3373-3376.
Jung, S., et al., "On-demand generation of monodisperse femtolitre droplets by shape-induced shear", Lab Chip, Oct. 2010, vol. 10, pp. 2688-2694.
Liu, Y., et al., "Shear-Driven Redistribution of Surfactant Affects Enzyme Activity in Well-Mixed Femtoliter Droplets", Anal. Chem., Jun. 2009, vol. 81, No. 12, pp. 4922-4928.
He, M., et al., "Concentrating Solutes and Nanoparticles within Individual Aqueous Microdroplets", Anal. Chem., Mar. 2004, vol. 76, No. 5, pp. 1222-1227.
Janz, G. J., "Diffusion of Silver Nitrate in Concentrated Aqueous Solutions", The Journal of Physical Chemistry, Feb. 1966, vol. 70, pp. 536-539.
Sjoback, R., et al., "Absorption and fluorescence properties of fluorescein", Spectrochim. Acta A, Jun. 1995, vol. 51, pp. L7-L21.
Garstecki, P., et al., "Formation of droplets and bubbles in a microfluidic T-junction—scaling and mechanism of break-up", Lab Chip, Mar. 2006, vol. 6, pp. 437-446.
Gunther, A., et al., "Multiphase microfluidics: from flow characteristics to chemical and materials synthesis", Lab Chip, Sep. 2006, vol. 6, pp. 1487-1503.
Utada, A. S., et al., "Dripping to Jetting Transitions in Coflowing Liquid Streams", Phys. Rev. Lett., Aug. 2007, vol. 99, 094502.
Lorenz, R. M., et al., "Simultaneous generation of multiple aqueous droplets in a microfluidic device", Anal. Chim. Acta, Dec. 2008, pp. 124-130.
He, M., et al., "Selective Encapsulation of Single Cells and Subcellular Organelles into Picoliter- and Femtoliter-Volume Droplets", Anal. Chem., Mar. 2005, vol. 77, No. 6, pp. 1539-1544.
He, M., et al., "Electro-generation of single femtoliter- and picoliter-volume aqueous droplets in microfluidic systems", Appl. Phys. Lett., Jul. 2005, vol. 87, 031916.

FIG. 2A
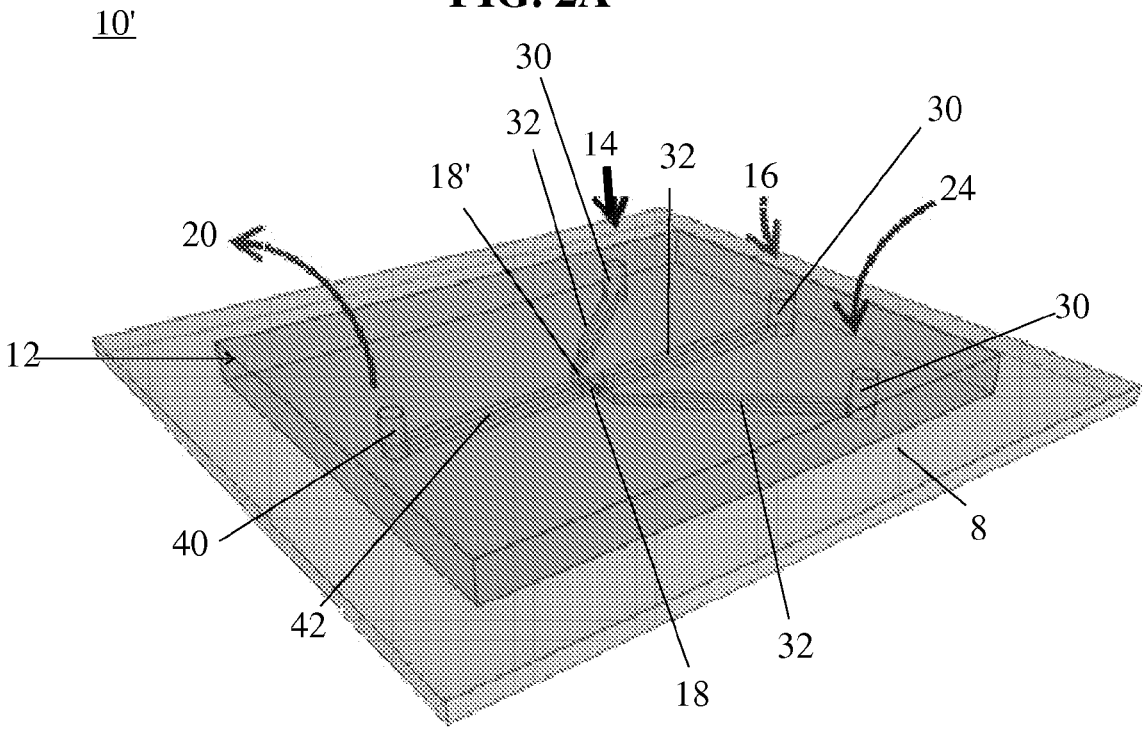
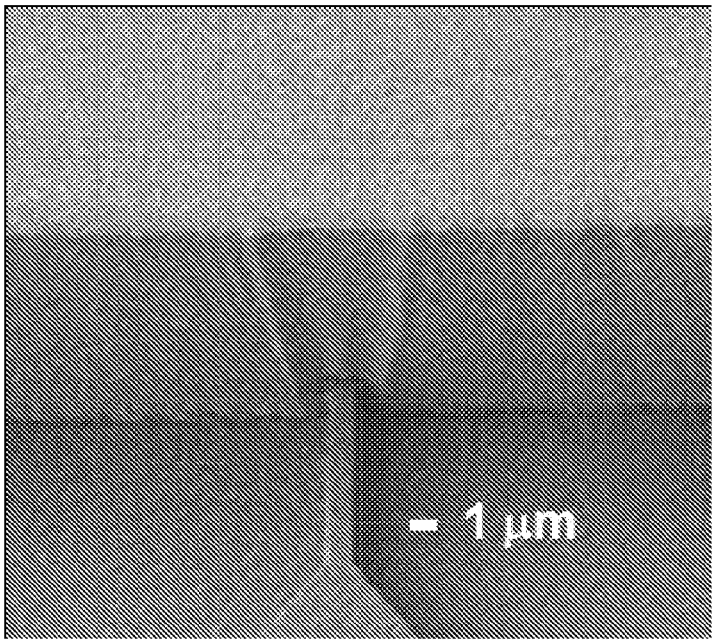
FIG. 2B

FIG. 4A
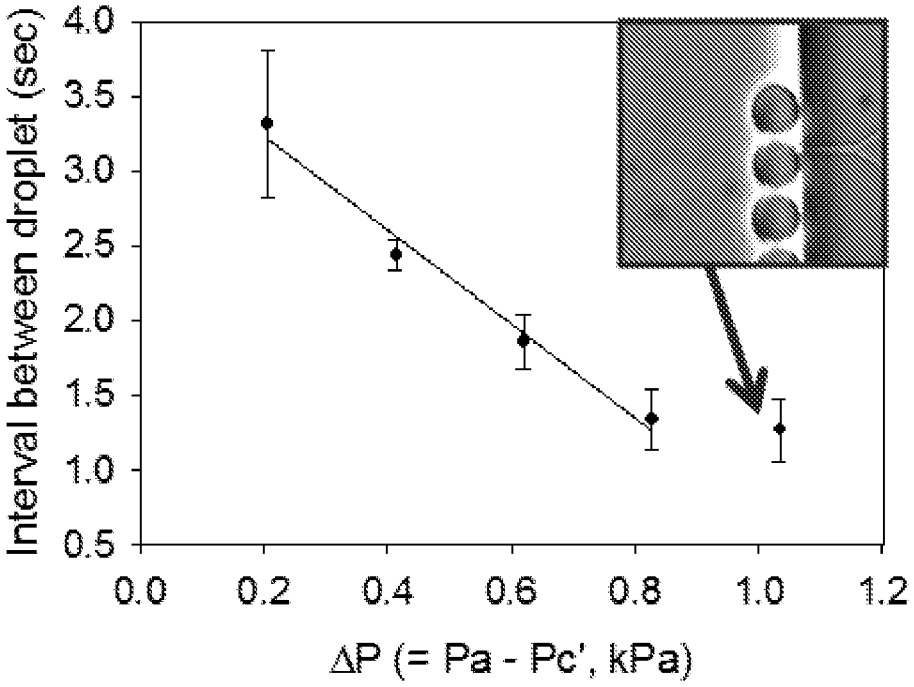
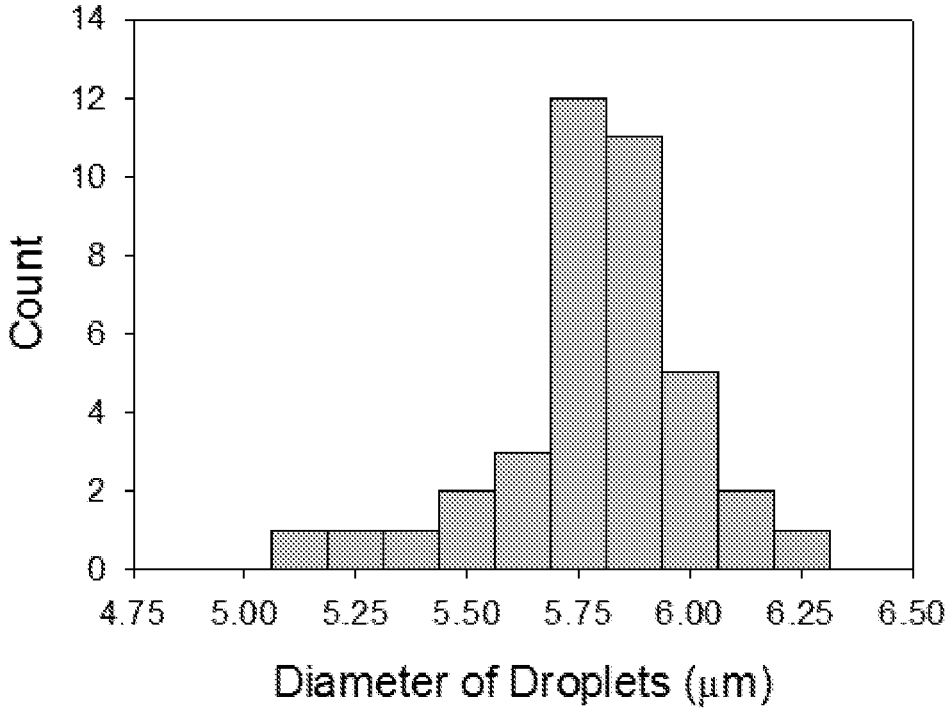
FIG. 4B

GENERATION OF MONODISPERSE DROPLETS BY SHAPE-INDUCED SHEAR AND INTERFACIAL CONTROLLED FUSION OF INDIVIDUAL DROPLETS ON-DEMAND

FIELD OF THE INVENTION

The present disclosure relates to a microfluidic device, and more particularly, to a microfluidic device for on-demand generation of monodisperse droplets and a method of forming such monodisperse droplets by shaped-induced shear and interfacial controlled fusion. The present disclosure also relates to a method of initiating a chemical reaction with high spatial and temporal resolution utilizing a microfluidic device of the present disclosure.

BACKGROUND

Droplet-based microfluidic platforms offer many opportunities to confine chemical and biochemical reactants in discrete ultra-small reaction volumes, and investigate the effects of increased confinement on reaction kinetics. Most droplet-based systems rely on generation of continuous streams of droplets in multiphase segmented flows, either via a "squeezing" mechanism involving pressure fluctuations related to periodic blocking of oil flow in a channel by aqueous plugs, or by "dripping" or "jetting" mechanisms involving shearing of the aqueous phase by the oil phase.

Droplets are generated in such flows at high frequencies and transported downstream at high flow rates, which complicates efforts to initiate chemical reactions with a well-defined time zero, analyze reaction kinetics in real time, and further manipulate droplets to carry out sequential multistep reactions. In addition, generation of the smallest droplet sizes (1-10 μm in diameter) due to droplet splitting generally requires strong shear stresses, which can adversely affect the distribution of surfactant stabilizing the oil-water interface and the passivation of the interface against nonspecific adsorption of biomolecules such as enzymes. On-demand generation of droplets allows more precise temporal control of reactions inside droplets since each droplet can be individually triggered, tracked and manipulated.

Methods to control droplet splitting on-demand involve thinning or breaking the aqueous thread connecting a growing droplet to the water pore to which it is attached, due to local extensional and shear stresses at the orifice. The resulting size of the droplet, or whether or not multiple droplets or even aqueous jets are injected into the oil phase, will depend on competition between the rates of thinning of the aqueous thread versus inflation of the droplet by fluid flow through the orifice. For water-in-oil droplets created rapidly under steady-state conditions with continuous segmented flows, shear is provided by the cross flow of the oil phase.

To form individual droplets on-demand without cross flow, some other mechanism is necessary to create sufficient shear. Recent examples of on-demand droplet generation methods in the absence of steady-state cross flows include the use of programmable microinjectors, syringe pumps, piezoelectric actuators, high-voltage pulses, electrowetting on dielectrics, and use of dielectrophoretic pressure. These methods rely on actively controlled mechanical displacements of the water-oil interface sufficient to split off aqueous droplets one at a time at junctions of aqueous and oil channels. On the other hand, continuous multiphase flows in microchannels generally rely on passive means for forming water-in-oil droplets, based on flow instabilities induced by interfacial forces.

SUMMARY

In one aspect of the present disclosure, a microfluidic device that is capable of generating individual monodisperse water-in-oil droplets on-demand is provided. The microfluidic device of the present disclosure can be thought of as having a central oil microchannel with one or more microjunction orifices due to intersection with one or more aqueous microchannels.

The term "monodisperse droplets" is used throughout the present application to denote droplet diameters that are described by a size distribution histogram from a statistically significant population of droplets formed with this method having a coefficient of variation (standard deviation divided by the mean) of less than or equal to 3.5%. The term "water-in-oil droplets" is used throughout the present application to denote either pure water droplets, or aqueous droplets consisting of salts, proteins, nanoparticles, or other molecular or particulate species dissolved or suspended in solution, dispersed in an immiscible oil phase with or without the inclusion of surfactant molecules or other surface-active species at the oil/water interface.

The monodisperse droplets are formed in the absence of a perpendicular cross flow of oil or any active mechanism, e.g., programmable microinjectors, syringe pumps, piezoelectric actuators, high-voltage pulses, electrowetting on dielectrics, and use of dielectrophoretic pressure. Instead, the monodisperse droplets are formed on-demand in the present disclosure by an abrupt change in a microchannel dimension across a microjunction orifice, for example, from a 1 μm height and/or width of an aqueous microchannel to an 18 μm height and/or width of an oil microchannel. This increase in height and/or width allows the rapidly growing droplet room to expand both vertically and horizontally away from the orifice in order to minimize the surface energy of the droplet by approximating a spherical shape.

The microfluidic device of the present disclosure is a monolithic device that comprises a first input microchannel having a first dimension and a second input microchannel having a second dimension, wherein the second dimension is different from the first dimension. In accordance with the present disclosure, the term "dimension" is used throughout the present application to denote either a microchannel height or a microchannel width. A microchannel junction is also present and is in communication with both the first input microchannel and the second input microchannel. The microfluidic device of the present disclosure also comprises an output channel in communication with the microchannel junction and set to receive a monodisperse droplet. In the microfluidic device of the present disclosure, the difference between the first dimension and the second dimension creates an interfacial tension induced force at the microchannel junction which forms a monodisperse droplet and causes the monodisperse droplet to detach from a microchannel junction orifice.

The term "interfacial tension induced force" is used throughout the present application to denote a force that depends on the interfacial tension and surface curvature of the oil-water interface of either a dispersed water or aqueous droplet in the oil phase, or at a meniscus connecting the two phases inside a microchannel. In the context of forming a monodisperse droplet on-demand with this method, the interfacial tension induced force is the driving force for spontaneously forming an individual droplet on-demand at the microjunction orifice. This driving force arises from the abrupt change in channel dimension at the microjunction orifice, which allows a nascent droplet room to assume a spherical shape, minimizing the interfacial tension and hence the surface energy of the droplet.

In some embodiments, the microfluidic device also includes a third input microchannel having a third dimension and another microchannel junction that is in communication with the third input microchannel and the second input microchannel. In this embodiment, the third dimension is different from at least the second dimension of the second input microchannel. The difference in the third dimension and the second dimension creates another interfacial tension induced force at its associated microchannel junction to generate another monodisperse droplet which can fuse with the previously formed monodisperse droplet, forming a fused monodisperse product droplet.

In another aspect of the present disclosure, a method of forming a monodisperse droplet is provided. The method of the present disclosure comprises first providing a microfluidic device. The microfluidic device comprises a first input microchannel having a first dimension, a second input microchannel having a second dimension, a microchannel junction in communication with the first input microchannel and the second input microchannel, and an output channel in communication with the microchannel junction. In accordance with the method of the present disclosure, the second dimension is different from the first dimension. Next, a first phase (for example, water or aqueous solution) is provided to the first input microchannel and a second phase (for example, oil) is provided to the second input microchannel. In accordance with the method of the present disclosure, the first phase is immiscible with the second phase. In the method of the present disclosure, the difference in the first dimension and the second dimension creates an interfacial tension induced force acting at the interface between the two immiscible phases at the microchannel junction to form a monodisperse water-in-oil droplet, and causes the monodisperse droplet to detach from a microchannel junction orifice.

In some embodiments, the microfluidic device further comprising a third input microchannel having a third dimension and another microchannel junction that is in communication with the third input microchannel and the second input microchannel. In this embodiment, the third dimension is different from at least the second dimension of the second input microchannel. The difference in the third dimension and the second dimension creates another interfacial tension induced force at its associated microchannel junction to generate another monodisperse droplet which can fuse with the previously formed monodisperse droplet, forming a fused monodisperse product droplet.

In yet another aspect of the present disclosure, a method of initiating a chemical reaction is provided. In this aspect, the method comprises providing a microfluidic device. The microfluidic device used for initiating a chemical reaction comprises a first input microchannel having a first dimension, a second input microchannel having a second dimension, and a third input microchannel having a third dimension. The microfluidic device also includes a first microchannel junction in communication with the first input microchannel and the second input microchannel, a second microchannel junction in communication with the third input microchannel and the second input microchannel, and an output channel in communication with the first and second microchannel junctions. The method of initiating a chemical reaction further includes providing a first aqueous reactant to the first input microchannel, an oil to the second input microchannel and a second aqueous reactant to the third input microchannel, wherein the first aqueous reactant and the aqueous second reactant are immiscible in the oil. A first monodisperse droplet is formed that comprises the first aqueous reactant in the oil, wherein the difference in the first dimension and the second dimension creates a first interfacial tension induced force at the first microchannel junction which forms the first monodisperse droplet. A second monodisperse droplet is formed, simultaneously with, or sequentially to, the first monodisperse droplet. The second monodisperse droplet comprises the second aqueous reactant in the oil, wherein the difference in the third dimension and the second dimension creates a second interfacial tension induced force at the second microchannel junction which forms the second monodisperse droplet. The second monodisperse droplet then interacts with the first monodisperse droplet to form a fused monodisperse product droplet dispersed in the oil phase comprising a reaction product of the first aqueous reactant and the second aqueous reactant.

BRIEF DESCRIPTION OF THE DRAWINGS

FIG. 1A is a schematic view, while FIG. 1B is a scanning electron microscope (SEM) image.

FIGS. 2A-2B illustrate a microfluidic device in accordance with another embodiment of the present disclosure; FIG. 2A is a schematic view, while FIG. 2B is a scanning electron microscope (SEM) image.

FIG. 4A is a plot of droplet formation intervals from a 1×1 μm orifice as functions of the pressure difference ΔP across the water-oil interface; the inset shows that at and above ΔP=1.0 kPa, the droplet formation interval is affected by previously formed droplets blocking the junction orifice.

FIG. 4B is a droplet diameter size distribution histogram corresponding to steady-state droplet formation over the range of ΔP values in FIG. 4A.

FIG. 5A 10 msec pulse, $P_a$=134.5 kPa, FIG. 5B 10 msec pulse, $P_a$=138.6 kPa, FIG. 5C 15 msec pulse, $P_a$=134.5 kPa, and FIG. 5D 20 msec pulse, $P_a$=134.5 kPa.

FIG. 9A initial droplet with fluorescein/HCl(aq) at pH 2.81 (right arrow). FIG. 9B after fusion with 2 NaOH(aq) droplets (left arrow), pH now 6.56. FIG. 9C after fusion with HCl(aq) droplet (right arrow), final pH 4.98.

DETAILED DESCRIPTION

The present disclosure, which provides a microfluidic device for on-demand generation of monodisperse droplets, a method of forming such monodisperse droplets by shaped-induced shear and interfacial control fusion, and a method of initiating a chemical reaction utilizing a microfluidic device of the present disclosure, will now be described in more detail by referring to the following discussion and drawings that accompany the present application. It is noted that the drawings are provided for illustrative purposes only and are not drawn to scale.

In the following description, numerous specific details are set forth, such as particular structures, components, materials, dimensions, processing steps and techniques, in order to illustrate the present disclosure. However, it will be appreciated by one of ordinary skill in the art that various embodiments of the present disclosure may be practiced without these, or with other, specific details. In other instances, well-known structures or processing steps have not been described in detail in order to avoid obscuring the various embodiments of the present disclosure.

Figure 1A:
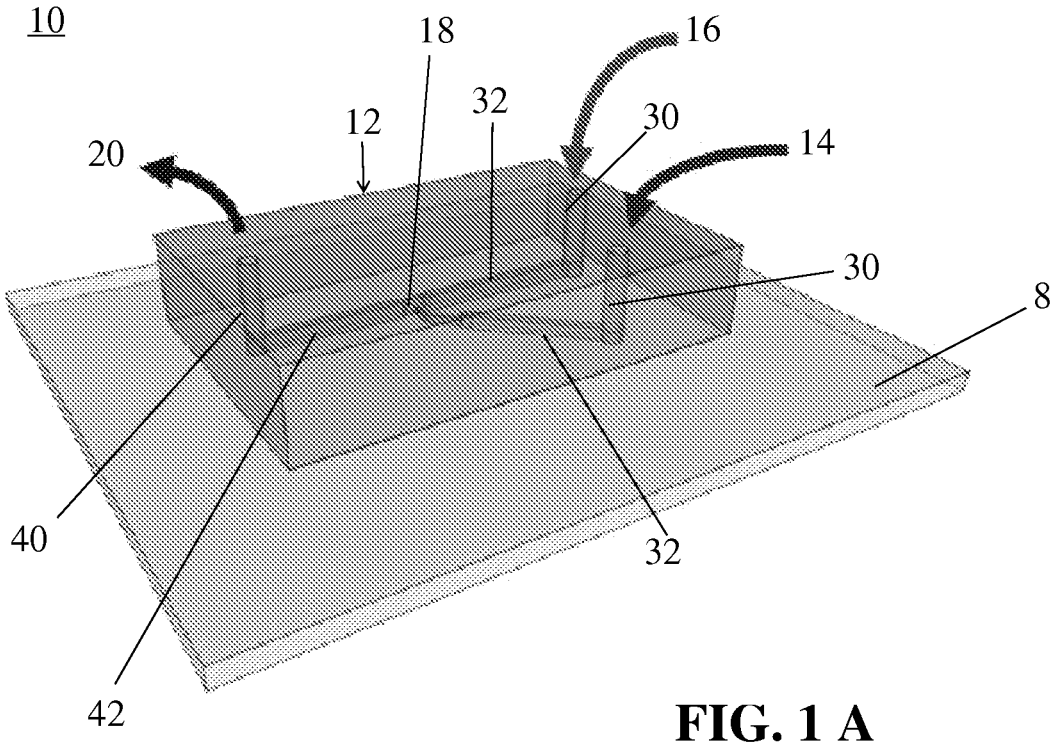
FIGS. 1A-1B illustrate a microfluidic device in accordance with an embodiment of the present disclosure.
Figure 1B:
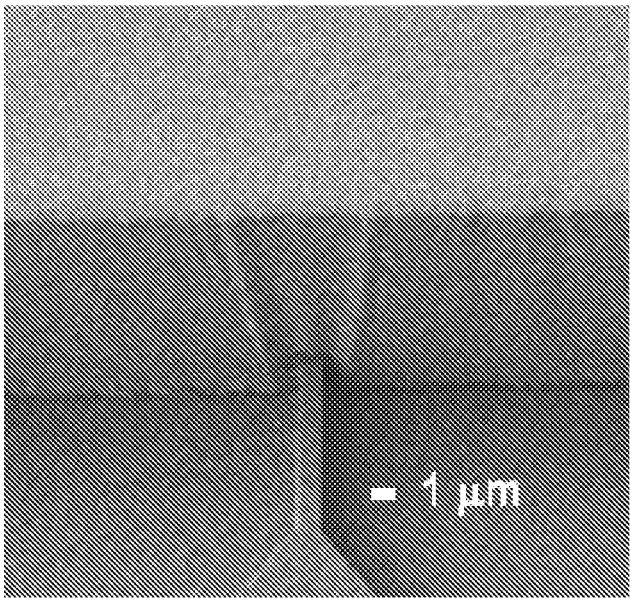

Reference is first made to FIGS. 1A-2A which illustrate two types of microfluidic devices in accordance with the present disclosure. The microfluidic devices are unitary in construction, i.e., they are monolithic, and include a central oil microchannel (comprising elements 16 and 20 to be described in greater detail herein below) with one or more microjunction orifices due to intersection with one or more aqueous microchannels (comprising elements 14 and 24 to be also described in more detail herein below). FIGS. 1B and 2B show actual SEMs of the microfluidic devices illustrated in FIGS. 1A and 2A, respectively. Specifically, FIG. 1A shows a microfluidic device 10 including two input microchannels, while FIG. 2A shows a microfluidic device 10' comprising three input microchannels. Each microfluidic device 10 or 10' is located on a base or substrate 8. It is emphasized that while the present disclosure describes and illustrates microfluidic devices including two and three input microchannels, the microfluidic devices of the present application are not limited to those number of input microchannels. Instead, microfluidic devices of the present disclosure can include a plurality of input microchannels having a plurality of microchannel junctions. The term "microchannel junction" is used throughout the present disclosure to denote an area in the device in which two microchannels intersect. The term "microchannel junction orifice" denotes an opening at the junction in which two phases (e.g., oil and water) intersect with each other.

The microfluidic device 10 shown in FIG. 1A includes a first input microchannel 14 having a first dimension D1 and a second input microchannel 16 having a second dimension D2. In accordance with the present disclosure, the second dimension D2 of the second input microchannel 16 is different from the first dimension D1 of the first input microchannel 14. The microfluidic device 10 of FIG. 1A also includes a microchannel junction 18 which is in communication with the first input microchannel 14 and the second input microchannel 16. The microfluidic device 10 also includes an output channel 20 which is in communication with the microchannel junction 18. The output channel 20 is set to receive a monodisperse droplet (not shown) that is formed at the microchannel junction 18. In accordance with the present disclosure, the difference in the first dimension D1 of the first input microchannel 14 and the second dimension D2 of the second input microchannel 16 creates an interfacial tension induced force at the microchannel junction 18 which is capable of generating a monodisperse droplet at the microchannel junction 18. While water-in-oil droplets are being generated at one or more microchannel junction orifices, or during fusion events involving two or more droplets, there is no oil flow in the second input microchannel or the output microchannel. Oil flow is initiated in the second input microchannel only to flush out droplets from the output channel 20 in order to begin a new round of droplet generation and fusion events.

The microfluidic device 10' shown in FIG. 2A includes a first input microchannel 14 having a first dimension D1, a second input microchannel 16 having a second dimension D2, and a third input microchannel 24 having a third dimension D3. In accordance with the present disclosure, the second dimension D2 of the second input microchannel 16 is different from the first dimension D1 of the first input microchannel 14 and the third dimension D3 of the third input microchannel 24. In some embodiments, D1 and D3 have the same dimension. In another embodiment, D1 and D3 have different dimensions. In the microfluidic device depicted in FIG. 2A, the second input microchannel 16 is located between the first input microchannel 14 and the third input microchannel 24.

The microfluidic device 10' of FIG. 2A also includes a first microchannel junction 18 which is in communication with the first input microchannel 14 and the second input microchannel 16, and a second microchannel junction 18' that is in communication with the third input microchannel 24 and the second input microchannel 16. In one embodiment of the present disclosure, the second microchannel junction 18' is located directly apposed from the first microchannel junction 18. In yet another embodiment of the present disclosure, the second microchannel junction 18' is apposed, yet offset from the first microchannel junction 18.

The microfluidic device 10' also includes an output channel 20 which is in communication with the first microchannel junction 18 and the second microchannel junction 18'. The output channel 20 is set to receive a fused monodisperse droplet (not shown) that is formed by combining a first monodisperse droplet formed at the first microchannel junction 18, and a second monodisperse droplet that is formed at the second microchannel junction 18'. In accordance with the present disclosure, the difference in the first dimension D1 of the first input microchannel 14 and the second dimension D2 of the second input microchannel 16 creates an interfacial tension induced force at the first microchannel junction 18 which is capable of forming a first monodisperse droplet at the microchannel junction 18. Also, the difference in the third dimension D3 of the third input microchannel 24 and the second dimension D2 of the second input microchannel 16 creates a second interfacial tension induced force at the second microchannel junction 18' which is capable of forming a second monodisperse droplet at the second microchannel junction 18'. In this embodiment, the first and second monodisperse droplets can fuse together.

In each microfluidic device of the present disclosure, an orifice (also referred to herein as a microjunction orifice) is present at the ends of each of the input microchannels. One of the orifices allows a phase from an adjoining reservoir to enter into the input microchannel, while the other orifice allows the phase from the input microchannel to flow into the corresponding microchannel junction. In the disclosed devices, each input microchannel has a vertical portion 30 that extends upward from a horizontal portion 32. The output channel of the disclosed devices also has a vertical portion 40 that extends upward from a horizontal portion 42. The horizontal portions of the output channel and the input channels meet at a microchannel junction.

The various elements of the microfluidic device 10 or 10' of the present application, including the input microchannels, the microchannel junctions and the output channel are located within, i.e., encased in, a housing 12. In one embodiment of the present disclosure, housing 12 of the microfluidic device 10' or 10' is of unitary construction, i.e., the housing is composed of a single monolithic piece. In another embodiment of the present disclosure, the housing 12 of the microfluidic device 10 or 10' is composed of two or more separate pieces that can be bonded together.

In one embodiment, the housing 12 of the microfluidic device 10 or 10' can be comprised of an elastomer rubber which typically includes a thermosetting polymer, i.e., a polymeric material that irreversibly cures. The elastomer rubber employed typically comprises carbon, hydrogen, oxygen and/or silicon. In one embodiment, the elastomer rubber can be an unsaturated rubber (vulcanized or non-vulcanized) such as, for example, polyisoprene, polybutadiene, chloroprene rubber, polychloroprene rubber, butyl rubber (i.e., a copolymer of isobutylene and isoprene), halogenated butyl rubbers (e.g., chloro butyl rubber and bromo butyl rubber), styrene-butadiene rubber, nitrile rubber (i.e., copolymer of butadiene and acrylonitrile), and halogenated nitrile rubbers.

In another embodiment, the elastomer rubber that can be employed as the material for housing 12 includes a saturated rubber such as, for example, ethylene propylene rubber, EPDM rubber (i.e., ethylene propylene diene rubber), epichlorohydrin rubber, polyacrylic rubber, silicone rubber, fluorosilicone rubber, fluoroelastomers, perfluoroelastomers, polyether block amides, ethylene-vinyl acetate, and chlorosulfonated polyethylene.

In one embodiment, the housing 12 is comprised of a silicone rubber having a backbone that consists of Si—O—Si units. Illustrative examples of silicone rubbers that can be employed include for example, polydimethylsiloxane (PDMS), either as commercial formulations comprised of a base polymer and a curing agent (e.g., Sylgard 184, Dow Corning), or with a harder, custom PDMS formulation (hPDMS) having an increased modulus for devices where increased structural strength was needed to prevent collapse of microchannels during pattern transfer as disclosed in H. Schmid and B. Michel, *Macromolecules,* 2000, 33, 3042-3049, the entire content of which is incorporated herein by reference.

In another embodiment, the housing 12 of the microfluidic device 10 or 10' can be comprised of glass, quartz or silicon.

In one embodiment, the microfluidic devices of the present disclosure can be formed utilizing an imprinting process. In such a process, a master material that can be patterned by etching is first selected. Examples of master materials that can be employed in the present disclosure in forming the microfluidic devices include, but are not limited to, semiconductor wafers, glass, and quartz. In one embodiment of the present disclosure, the master material is a silicon wafer.

After providing the master material, one or more lithographic and etching steps can be used to define at least one of the elements of the microfluidic device 10 or 10' described above. Lithography includes, for example, applying a photoresist material to an upper surface of the master material, exposing the photoresist material to a desired pattern of radiation and then developing the exposed resist material utilizing a resist developer. In some embodiments, an etch mask can be applied to the master material prior to forming the photoresist material. Following the patterning of the photoresist, the exposed portions of the master material that were not protected by the patterned photoresist material are etched. In one embodiment, etching can include a dry etching process including, for example, reactive ion etching, ion beam etching, and plasma etching. In another embodiment, etching can include a chemical wet etchant. The patterned resist can be removed by utilizing a conventional resist removal processing such as, for example, ashing. In some embodiments, a second patterned resist can be formed. In this embodiment, a second etching step can be performed or the second etching step can be omitted.

In one embodiment, a first patterning (lithography and etching) step is used to define one of the input microchannels, and a patterned and cured photoresist is used to define another of the input microchannels.

Following the formation of the patterned master material, a molding process can be employed. In the molding process, an elastomeric precursor material(s) is(are) applied to the patterned master material, and then a curing step is employed to cure the elastomeric precursor material. Following curing, the patterned master is removed. A bonding process can then be employed to provide the microfluidic device shown in FIGS. 1A and 2A.

In some embodiments, lithography and etching is only used in forming the microfluidic device of the present application. This embodiment is applicable in instances in which the housing 12 comprises glass, quartz or silicon.

The shape of the input microchannels 12, 16 and 24 and the output channel 20 can be rectangular. In another embodiment, the input microchannels can contain rounded corners at the "roof" of the channels, depending on the method of fabrication. In some embodiments, for example, for channels replicated in PDMS by molding from a master, the raised features formed from positive-tone photoresist on the master that are replicated as channels in the PDMS replica can be rounded by heating the resist past its glass transition temperature for about 30 minutes, which is about 120° C. for most positive-tone photoresists.

In one embodiment of the present disclosure and when 1:1 aspect ratio aqueous microchannels, i.e., 1 micrometer width (height), are used, the microfluidic device is operated at a constant, i.e., fixed pressure. In this embodiment, the constant pressure can range from 0 kPa to 200 kPa, with a constant pressure range from 120 kPa to 140 kPa being more typical. For other embodiments, different fixed pressures can be used which are dependent on the specific geometry of the aqueous channels. In such instances, the capillary pressure in the channel can be determined using the following formula:

$$P_c=2\gamma \cos \theta_{oil}[1/a+1b]$$

where $P_c$ is the capillary pressure, $\gamma$ is the interfacial tension between the two immiscible phases employed, $\theta_{oil}$ is the contact angle of the wetting fluid, i.e., oil, with (hydrophobic) the microchannel walls, a is the width of the aqueous input microchannel, and b is the height of the aqueous input microchannel.

In yet another embodiment, the microfluidic device can operate using a sequence of pressure pulses that are within the ranges mentioned above. The pressure can be adjusted by utilizing a pressure regulator which is remote to the microfluidic device of the present disclosure; no other equipment such as microinjectors, syringe pumps, actuators, etc. is needed.

As stated above, the microfluidic device 10 illustrated in FIG. 1A has a first input microchannel 14 of a first dimension D1 and a second input microchannel 16 of a second dimension D2, while the microfluidic device 10' of FIG. 2A further includes a third input microchannel 24 having a third dimension D3. The term "dimension" is used throughout the present disclosure to denote a height and/or width. The height is a measurement of the horizontal portion, e.g., element 32, of each of the input microchannel channels, while the width is a measurement from one sidewall of the input microchannel to another, opposing sidewall of input channel as measured across the input microchannel at right angles to the length of the input microchannel.

In one embodiment, the first dimension D1 is a first height, and the second dimension D2 is a second height, in which the second height is greater than the first height. In this embodiment of the present disclosure, the second height is typically from 10 micrometers to 20 micrometers and the first height is typically from 0.5 micrometers to 5.0 micrometers. More typically, the second height is from 18 micrometers to 20 micrometers and the first height is typically from 1.0 micrometers to 3.3 micrometers.

In another embodiment in which the third input microchannel 24 is present, the second height of the second input microchannel 16 is greater than both the first height of the first input microchannel 14 and the third height of the third input microchannel 24. Typically, and in one embodiment, the second height is from 10 micrometers to 20 micrometers, the first height is from 0.5 micrometers to 5.0 micrometers, and the third height is from 0.5 micrometers to 5.0 micrometers. More typically, the second height is from 18 micrometers to 20 micrometers, the first height is from 1.0 micrometers to 3.3 micrometers, and the third height is from 1.0 micrometers to 3.3 micrometers. In the embodiment including a third input microchannel, D1 and D3 can have the same or different height.

In one embodiment, the first dimension D1 is a first width, and the second dimension D2 is a second width, in which the second width is greater than the first width. In this embodiment of the present disclosure, the second width is typically from 5.0 micrometers to 200 micrometers and the first width is typically from 0.5 micrometers to 5.0 micrometers. More typically, the second width is from 7.3 micrometers to 4.6 micrometers and the first width is typically from 1.0 micrometers to 3.3 micrometers.

In another embodiment in which the third input microchannel 24 is present, the second width of the second input microchannel 16 is greater than both the first width of the first input microchannel 14 and the third width of the third input microchannel 24. Typically, and in one embodiment, the second width is from 5.0 micrometers to 200 micrometers, the first width is from 0.5 micrometers to 5.0 micrometers, and the third width is from 0.5 micrometers to 5.0 micrometers. More typically, the second width is from 7.3 micrometers to 14.6 micrometers, the first width is from 1.0 micrometers to 3.3 micrometers and the third width is from 1.0 micrometers to 3.3 micrometers. In the embodiment including a third input microchannel, D1 and D3 can have the same or different width.

In accordance with the present disclosure, the difference in the first dimension D1 and the second dimension D2 creates an interfacial tension induced force at the first microchannel junction 18 which forms a monodisperse droplet and causes a monodisperse droplet to detach from each microjunction orifice. In the embodiment in which a third input microchannel is present, the difference in the third dimension D3 and the second dimension D2 creates another interfacial tension induced force at the second microchannel junction 18' between the second and third input microchannels which forms another monodisperse droplet. In this embodiment, the monodisperse droplet formed at the microchannel junction between the first and second input microchannels and the another monodisperse droplet formed at the microchannel junction between the second and third input microchannels can fuse, i.e., merge, forming a fused monodisperse droplet. In some embodiments of the present disclosure, the fused monodisperse product droplet can contain a reaction product formed between a first aqueous reactant, present initially only in the first droplet, and a second aqueous reactant present initially only in the second droplet.

In forming the monodisperse droplets in the microfluidic device depicted in FIG. 1A, a first liquid phase is added to the first input microchannel 14 and is in fluid communication with the first input microchannel 14, and a second liquid phase is added to the second input microchannel 16 and is in fluid communication with the second input microchannel 16. The first and second liquid phases flow through the respective input channels, using only a pressure regulator, and a droplet forms at the microchannel junction 18 as described above.

In accordance with the present disclosure, the first phase is immiscible in the second phase. In one embodiment, the first phase can be an aqueous solution such as, water or deionized water, while the second phase is any oil or organic phase immiscible with water or aqueous solutions. In this embodiment, the corresponding monodisperse droplet comprises an aqueous droplet dispersed in an oil phase. The first phase may also include aqueous organic compounds, aqueous inorganic compounds, aqueous biological compounds, acids, bases, or their corresponding salts, or particulate matter suspended in aqueous solution, such as micro or nanoparticles or beads, as discussed in greater detail herein below.

The oil that can be employed as the second phase is any substance that is liquid at ambient temperatures and is hydrophobic but soluble in organic solvents. In one embodiment, the oil that can be used as the second phase includes, but is not limited to, coconut oil, corn oil, cottonseed oil, olive oil, palm oil, peanut oil, rapeseed oil, safflower oil, soybean oil, sunflower oil, almond oil, cashew oil, hazelnut oil, walnut oil, citrus oil, carrot seed oil, castor oil, tall oil, jojoba oil, fluorinated oils, silicone-based oils, and mineral oil. Mixtures of the aforementioned oils can also be employed as the second phase. The second phase can also be any organic solvent that is liquid at ambient temperature and is immiscible with water. Examples include, but are not limited to, alkanes, alkenes, aromatic compounds such as benzene and its modifications such as toluene or phenol, etc.

In forming the fused monodisperse droplets in the microfluidic device depicted in FIG. 2A, a first phase is added to the first input microchannel 14 and is in fluid communication with the first input microchannel 14, a second phase is added to the second input microchannel 16 and is in fluid communication with the second input microchannel 16, and a third phase is added to the third input microchannel 24 and is in fluid communication with the third input microchannel 24. The first and second phases flow through the respective input microchannels and a droplet forms at the microchannel junction 18 as described above. Also, the third and second phases flow through the respective input microchannels and a droplet forms at the second microchannel junction 18' as described above. The droplets that form at the various microchannel junctions can be simultaneously or sequentially formed. In accordance with the present disclosure, the first phase and the third phase are immiscible in the second phase. In one embodiment, the first and third phases are different from each other and in some instances they comprise solutions that contain dissolved or suspended reactants that react with each other forming a reaction product in a fused monodisperse droplet. As such, the present disclosure provides a method for initiating a reaction at a well-defined time and location. The reaction can be, for example, a chemical reaction or a biological reaction.

In the embodiment including three input channels, the second phase that is added to the second input channel 16 is typically an oil as described above. The first and third phases are aqueous reactants that can be selected from aqueous organic compounds (i.e., organic compounds that are miscible in water), aqueous inorganic compounds, aqueous biological compounds, acids, bases, or their corresponding salts, or particulate matter suspended in aqueous solution, such as micro or nanoparticles or beads.

When an aqueous organic compound is employed, the organic compound that can be employed must be miscible in water. Examples include, but are not limited to, halides, alcohols, ethers, carbonyls, aldehydes, ketones, esters, carboylic acids, carboxylic acids chlorides, amides, amines, nitriles, nitros, sulfides, sulfoxides, and sulfones.

When an aqueous inorganic compound is employed, the inorganic compound must be miscible in water. Examples include, but are not limited to, metal acetates, metal halides, metal citrates, metal hydroxides, metal nitrates, metal nitrites metal phosphates, and metal sulfates. The metal component can be any metallic element including, for example, alkali metals, alkaline earth metals, rare earth metals, transition metals, lanthanide metals, actinide metals and mixtures thereof. In one embodiment, aqueous solutions of $AgNO_3$ and NaCl as dissolved salts are used as the aqueous inorganic compounds for the first and third phases. In such an embodiment, a fused monodisperse product droplet containing solid AgCl precipitate can form.

When a biological compound is employed, the biological compound can include, but is not limited to, an amino acid, a protein, a peptide, phospholipids, sphingosines, fatty acids, ceramides, a sugar, an antigen, an antibody, an enzyme, serum, DNA, RNA, and any complexes formed from these compounds. The biological compound could also include individual living cells or multiple living cells.

When an acid is employed, the acid includes any compound that dissociates in solution, releasing hydronium ions and lowering the solution pH (a proton donor). The acid can be an organic acid or a mineral acid. Illustrative examples of acids that can be employed include, but are not limited to, hydrochloric acid, nitric acid, phosphoric acid, sulfuric acid, hydrofluoric acid, hydrobromic acid, lactic acid, acetic acid, formic acid, citric acid, oxalic acid, and uric acid.

When a base is employed, the base includes any compound that can accept protons. Examples of suitable bases that can be employed include, but are not limited to, pyridine, methyl amine, imidazole, benzimidazole, histidine, phosphazene bases, potassium hydroxide, barium hydroxide, cesium hydroxide, sodium hydroxide, and lithium hydroxide.

In one embodiment, the first phase may be an acid or base, and the third phase is the other of an acid or base not used as the first phase. In this embodiment, an acid-base reaction can occur.

In some embodiments of the present application, a surfactant can be added to at least one, but can be added to two or more of the input microchannels. The use of the surfactant lowers the surface tension between the phase within the input microchannel and the walls of the input microchannel. The surfactant that can be used in the present disclosure includes ionic (anionic and cationic) surfactants, zwitterionic surfactants, and/or nonionic surfactants.

Examples of anionic surfactants include, but are not limited to, sulfates such as alkyl sulfates (e.g., ammonium lauryl sulfate and sodium lauryl sulfate), alkyl ether sulfates (e.g., sodium laureth sulfate and sodium myeth sulfate), sulfonates (e.g., dioctyl sodium sulfosuccinate), sulfonate fluorosurfactants (e.g., perfluorooctanesulfonate and perfluorobutanesulfonate), alkyl benzene sulfonates, phosphates such as, for example, alkyl aryl ether phosphate and alkyl ether phosphate, carboxylates such as, for example, alkyl carboxylates (e.g., fatty acids salts and sodium stearate), sodium lauroyl sarcosinate, and carboxylate fluorosurfactants such as, for example, perfluorononanoate and perfluorooctanoate.

Examples of cationic based surfactants include, but are not limited to, primary, secondary or tertiary amines, and quaternary ammonium compounds (e.g., alkyltrimethylammonium salts, cetylpyridinium chloride, polyethoxylated tallow amine, benzalkonium chloirde, nenzethonium chloride, dimethyldiocadecylammonium chloride, and dioctadecyldimethylammonium bromide).

Examples of zwitterionic surfactants include primary, secondary or tertairy amines, or quaternary ammonium cations with sulfonates (e.g., (3-[(3-Cholamidopropyl)dimethylammonio]-1-propanesulfonate) or sultaines), carboxylates (i.e., amino acids, imino acids and betaines) or phosphates (e.g., lecithin).

Examples of nonionic surfactants include fatty alcohols (e.g., cetyl alcohol, stearyl alcohol, cetostearyl alcohol and oleyl alcohol), polyoxyethylene glycol alkyl ethers (e.g., octaethylene glycol monododecyl ether and pantaethylene glycol monododecyl ether), polyoxypropylene glycol alkyl ethers, glucoside alkyl ethers (e.g., decyl glycoside, lauryl glucoside and octyl glucoside, polyoxyethylene glycol alkylphenol ethers, glycerol alkyl esters (e.g., glyceryl laurate), polyoxyethylene glycol sorbitan alkyl esters, sorbitan alkyl esters, cocamide MEA, cocamide DEA, dodecyldimethylamine oxide, and block copolymers of polyethylene glycol and polypropylene glycol.

In one embodiment of the present disclosure, 4-Nonylphenyl-polyethylene glycol is employed as the surfactant.

In some embodiments, ionic liquids, which are salts that are molten at room temperature can be employed as the surfactant and or one of the phases mentioned above. Examples of ionic liquids that can be employed in the present disclosure include, but are not limited to salts comprised of cationic species, such as imidazolium, phosphonium, and ammonium compounds, associated with anionic species, such as borate, halide, sulfate, acetate, phosphate, and sulfonate compounds.

Notwithstanding the type of phases and surfactants employed, the monodisperse droplets or fused droplets are spherical in shape and typically have a diameter in the range from 3.0 μm to 15 μm, with a diameter in the range from 3.5 μm to 5.5 μm being more typical. The monodisperse droplets are typically composed of at least one aqueous component in an oil phase. The monodisperse droplets or fused droplets can form in a millisecond or less utilizing the microfluidic device of the present disclosure.

The following examples are provided to illustrate some aspects of the present disclosure.

EXAMPLE 1

On-Demand Formation of Femtoliter Water-in-Oil (W/O) Droplets

Deionized water was used as the aqueous phase. Soybean oil (Sigma Aldrich) was purified of surface-active contaminants (mainly monoglycerides) by gravity filtration through a column packed with a 1:1 mixture of fluorisil and silica gel (100-200 mesh, Sigma-Aldrich) until the equilibrium interfacial tension at the oil-water interface matched that of reported values for purified soy oil in the literature ($\gamma$=31 mN/m). 4-Nonylphenyl-polyethylene glycol (NP-PEG) surfactant (Sigma-Aldrich) was diluted 0.1% to 1.0% v/v in the purified soy oil in some of the experiments. Interfacial tensions of oil/water, with and without NP-PEG surfactant, and contact angles on PDMS surfaces were determined from analyses of captured digital images of pendant and sessile drops, as described previously.

A microfluidic device in accordance with the present disclosure was fabricated in poly(dimethylsiloxane) (PDMS) using a multilayer soft-lithographic technique, e.g., imprinting. A combination of electron beam lithography and photolithography was used to fabricate silicon masters for fabricating PDMS devices by micromolding. The aqueous channel was defined on the master with 300 nm thick electron beam resist (ZEP-520A, Zeon Corp.; Tokyo, Japan), which was spin coated onto a 100 mm Si wafer at 6000 rpm for 45 seconds and then soft baked for 2 minutes at 180° C. The resist was exposed to an electron beam from a JEOL 9300-FS Electron Beam Lithography System with a dose of 500 $\mu C/cm^2$ and patterns were developed in xylene for 30 seconds, rinsed with isopropanol (IPA) and dried with nitrogen gas. After a brief oxygen plasma treatment (Technics RIE, 100 sccm $O_2$, 150 mTorr, 100 W for 6 seconds), a chromium layer 15 nm thick for use as an etch mask was evaporated onto the patterned Si wafer with a custom dual gun electron beam evaporator at a deposition rate of 1 Å/sec, followed by lift-off by sonication in acetone. The desired height of the aqueous microchannel was achieved in bas relief by dry etching Si with an Oxford Plasmalab 100 inductively coupled plasma reactive ion etching system at an etch rate ~200 nm/min (Oxford Instruments, Concord, Mass.).

The oil channel was defined using SU8 2015 negative-tone photoresist (Microchem Corp., Newton, Mass.). The photoresist was spin-coated at 2000 rpm and soft-baked for 6 minutes at 90° C. The photoresist-coated wafer was aligned and exposed to UV light under a photomask at ~13 $mW/cm^2$ for 18 seconds on a contact aligner (Neutronix-Quintel, Morgan Hill, Calif.). After a 6 minute post exposure bake at 90° C., the resist was developed in SU8 developer (Microchem Corp., Newton, Mass.), rinsed with IPA and dried with nitrogen. The height of the etched Si feature defining the aqueous channel was 1 μm, and the height of the SU8 photoresist feature defining the oil channel on the master was 18 μm, as measured with a Dektak profilometer (Veeco, Malvern, Pa.). The profiles of both the oil and aqueous channel features were rectangular.

The microfluidic device was fabricated by bonding a PDMS replica, with the microchannels molded into it, onto a PDMS-coated glass coverslip, so that all channel walls are PDMS. For the PDMS replica, the Si mold was silanized with trimethylchlorosilane vapor (Aldrich) for 30 minutes in order to facilitate release of the PDMS from the mold after curing. Sylgard 184 PDMS (Dow Corning, Midland, Mich.) with a 10:1 mass ratio of base to curing agent was thoroughly mixed, degassed, poured onto the mold and degassed again, followed by curing for 30 minutes at 120° C. The cured PDMS replica was peeled off from mold and holes were punched with a 0.75 mm hole-puncher (Harris Uni-Core, Ted Pella, Inc. Redding, Calif.). The PDMS replica was bonded onto a #1 glass coverslip (Erie Scientific Co., Portsmouth, N.H.) that had a 10 μm-thick layer of PDMS spin coated onto it (6500 rpm), followed by curing for 30 minutes at 120° C. Bonding between the top PDMS replica and the bottom PDMS-coated glass coverslip was activated by plasma treatment of both bonding surfaces in an inductively-coupled plasma cleaner at 10.5 W for 20 seconds (Harrick, Ithaca, N.Y.). In order to render all the channel surfaces of the completed device sufficiently hydrophobic, the bonded chips were heated at 120° C. for an additional 48 hours to ensure hydrophobic recovery of the PDMS.

4 mL glass vials with PTFE/silicone septum lids (C4015-17W, National Scientific, Rockwood, Tenn.) were used as sample reservoirs for the aqueous and oil phases, and were connected to high precision closed-loop voltage-pressure transducers (Marsh Bellofram, Newell, W. Va.) by 24 gauge PTFE tubing (Small Parts, Miramar, Fla.). The reservoirs were connected to the inlets of the PDMS device by 23 gauge stainless steel tubing (Technical Innovations, Brazoria, Tex.). Male-to-male luer lock adapters (Qosina, Edgewood, N.Y.) holding two 23 gauge needles, one penetrating the septum of the vial cap, and the other connecting to the 24 gauge PTFE tubing, were used for access into and out of the sample vials. The pressure regulators were controlled by a custom Matlab script (Mathworks, Natick, Mass.) through an analog output board (16 bit resolution, 0-10 V range, USB3103, Measurement Computing, Norton, Mass.), and were calibrated using a Dwyer Series 475 Mark III digital manometer (Michigan City, Ind.). Bright field images were acquired with an inverted optical microscope (Eclipse TE 300, Nikon Instruments, Melville, N.Y.), using either a CCD camera (CoolSNAP-HQ, Roper Scientific, Tucson, Ariz.) controlled with Metamorph software (Universal Imaging Corp., Downing Town, Pa.), or a high-speed CMOS camera (EPIX SV643, Buffalo Grove, Ill.). Images were analyzed with ImageJ software (National Institutes of Health).

Figure 3A:
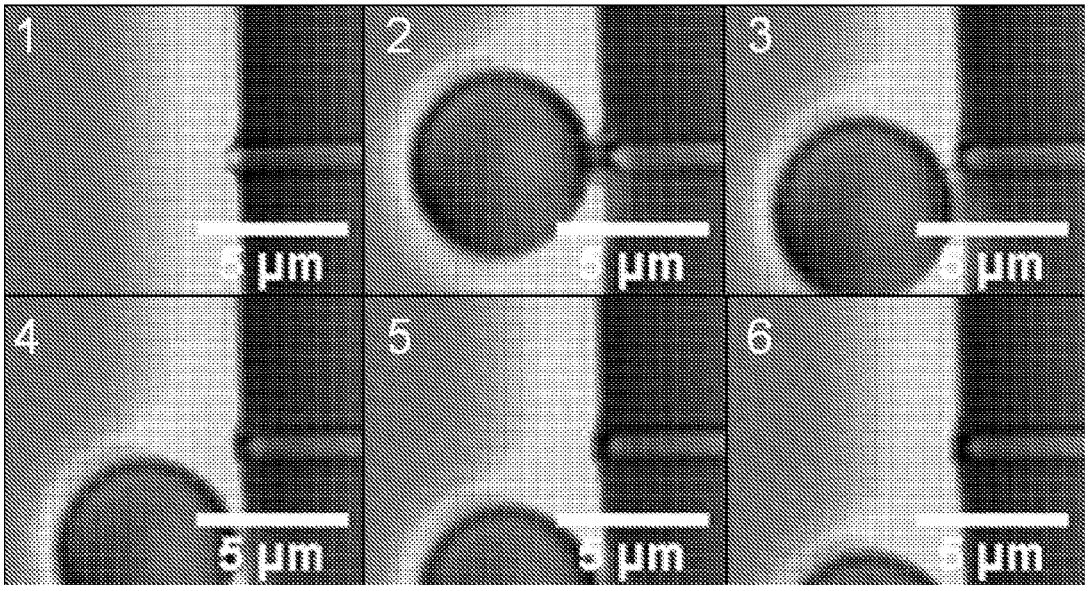
FIG. 3A is a series of bright field images spaced at 82 msec intervals of the formation and detachment of an individual 5.7 μm diameter droplet from an aqueous channel (1×1 μm) into the oil phase, at a constant backing pressure of 130.3 kPa.
Figure 3B:
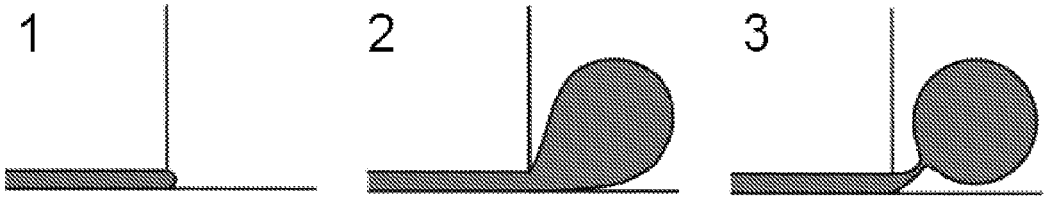
FIG. 3B is a cross sectional schematic of steps involved during droplet formation corresponding to bright field images in FIG. 3A.

FIG. 3A shows a series of bright field images, captured with a CCD camera every 82 msec (corresponding to the maximum frame transfer rate for the imaged pixel area), of an individual 5.7 μm diameter droplet forming and detaching from the orifice at the junction of a 1 μm wide×1 μm high×7 v long aqueous channel with a 200 μm wide×18 μm high main oil channel. This sequence was not triggered, but instead represents a series of successive "snapshots" taken under steady-state conditions, at a constant applied backing pressure of 130.3 kPa. FIG. 3B shows a schematic of the proposed droplet formation mechanism from a side-view perspective.

In the first panel of FIGS. 3A and 3B, the curved oil/water interface has started to protrude from the junction orifice with a hemispherical shape, which indicates the internal pressure acting on the water/oil interface was at or very close to the capillary hold-off value corresponding to spontaneous growth of the aqueous phase into the oil channel. By the next frame (within 82 msec), a fully grown droplet has formed at the interface, connected to the water channel by an aqueous neck. Bright field images captured with a fast CMOS camera (frame rate 841 μsec) indicated that the droplet formation process, beginning with the oil/water interface at the capillary hold-off value, was complete within 2.5 msec.

The distance from the floor of the device to the centerline of the aqueous channel (500 nm) was significantly less than that from the ceiling of the device to this centerline (17.5 μm). The abrupt change in channel height across the junction orifice, from the 1 μm height of the aqueous channel to the 18 μm height of the oil channel, allowed the rapidly growing droplet room to expand both vertically and horizontally away from the orifice in order to minimize the surface area of the droplet by approximating a spherical shape above the centerline of the orifice. However, at the hydrophobic floor and wall of the channel near the opening, the droplet shape was distorted from spherical due to steric hindrance.

This can be seen in the second panel of FIGS. 2A and B, which show an inflated droplet, the shape of which was clearly distorted from spherical, near the channel wall.

The local Laplace pressure at the nose of the droplet was less than that at the neck due to differences in the radii of curvature. The resulting pressure gradient resulted in local extensional and shear stresses at the oil-water interface that drives the growth of an oil film and thinning of the aqueous neck at the orifice.

This process results in the droplet splitting off from the orifice and recovering its lowest energy spherical shape. The newly freed droplet then drifted away from the orifice in the remaining panels, presumably due to slow fluid flow in the main oil channel from a slight hydrostatic pressure imbalance between the inlet and outlet of the oil channel. If needed, this slow drift in the oil channel could be controlled with pressure regulators.

FIG. 4A is a plot of steady-state droplet formation intervals for this channel geometry as a function of the pressure drop across the water-oil interface in the aqueous channel, taken from over 50 bright field images. The pressure difference between the applied backing pressure and an effective capillary pressure of the channel was assigned as, $\Delta P=P_a-P_{C'}$, wherein $P_{C'}$ corresponds to the minimum backing pressure required to pin the interface at its closest stable position behind the channel opening without flooding the oil channel; $\Delta P=0$ refers to an applied backing pressure equaling this effective capillary pressure. The difference between neighboring $\Delta P$ values in the plot, 0.2 kPa, corresponds to the resolution of the voltage-pressure transducers used to regulate the backing pressure, which was 0.1% of full scale (200 kPa).

Analyses of time dependent sequences of bright field images taken at each value of $\Delta P$ were used to generate the mean and standard deviation for each data point in FIG. 4A. Included in the plot is a linear fit ($R^2=0.98$) to the data except for the last data point at $\Delta P=1.0$ kPa, which did not follow the linear trend due to blocking of the aqueous channel opening by previously formed droplets, as shown by the image in the inset.

Bright field image sequences for the range of $\Delta P$ values used in FIG. 4A show that for most of the time between successive droplet generation events (1 to 3.5 seconds, depending on $\Delta P$), the water/oil interface in the aqueous channel was pinned at its stable initial position within the aqueous channel. The growth and detachment of a droplet was a rare, transient event within each droplet generation cycle, occurring rapidly (within 2.5 msec) once the interface moved to the channel opening and started to protrude into the oil phase. As each droplet split off from the orifice, the water/oil interface of the remaining water column recoiled back to its initial stable position within the aqueous channel, due to interfacial tension, to begin a new cycle.

FIG. 4B is a plot of the droplet diameter size distribution observed from bright field image sequences corresponding to 0.2 to 1.0 kPa, the range of $\Delta P$ values shown in FIG. 3A. The mean and standard deviation from this distribution was 5.7±0.2 μm, resulting in a coefficient of variation (COV=std/m×100%) of 3.5%. This diameter corresponded to a volume of 97 femtoliters for a spherical droplet. The fact that the droplet size distribution was relatively independent of the backing pressures used and frequencies of droplet formation was consistent with the fact that the ultimate droplet diameter was controlled more by interfacial tension than flow rate at this length scale.

The slow, predictable droplet generation intervals shown in FIG. 4A represents a different droplet formation methodology than steady-state approaches to produce droplets at high formation frequencies (up to kHz) based on continuous segmented flows, and allows interrogation, tracking and manipulation of individual droplets in the same way as active-control schemes for on-demand generation. This slow, predictable steady-state rate also enabled droplet formation to be gated, by application of pressure pulses instead of a constant applied pressure.

FIGS. 5A-5D show still images of droplet formation occurring after the application of a short pressure pulse (10-20 msec pulse duration). The number of droplets per pulse could be controlled either with the magnitude (FIGS. 5A and 5B) or the duration (FIGS. 5C and 5D) of the pressure pulse. Comparison of FIG. 5A with 5B showed that an increase in $\Delta P$ of just 4.1 kPa, for the same pulse duration (10 msec), resulted in a transition from one droplet per pulse for FIG. 5A to numerous droplets per pulse for FIG. 5B. For FIG. 5B, there were actually two sets of four-droplet injections per pulse, due to transient pressure oscillations from the Marsh-Bellofram voltage-to-pressure transducer.

Figures 5A, 5B, 5C, 5D:
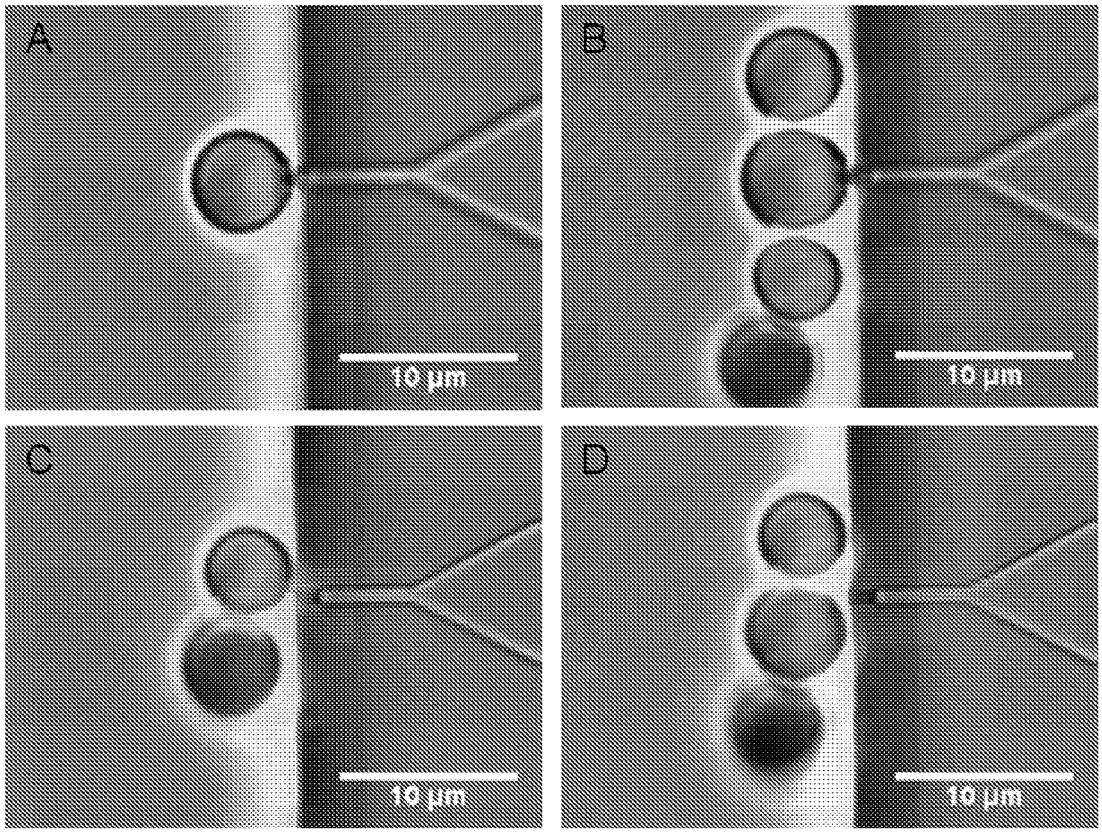
FIG. 5A-5D are still images of droplet formation during pulsed operation from four different movie sequences.

Varying the duration of the pressure pulse was an easier way to control the number of droplets per pulse in a digital manner than varying the magnitude of the pressure pulse. Comparison of FIGS. 5A, 5C and 5D show that by increasing the duration of the pulse from 10 msec to 15 msec to 20 msec, all at $P_a=134.5$ kPa, one, two or three droplets could be produced on-demand reproducibly. Oscillations in the positions of the oil/water interface in the channel occurred after each pulse due to the pressure transducer, but the oscillations did not extend all the way to the orifice of the channel as they did for FIG. 5B because the pressure was lower.

Another test involved reducing the oil channel height from 18 μm to 1 μm, which is the same height as the 1:1 aspect ratio aqueous channel. Without the room to inflate vertically into the 18 μm high oil channel, which would allow the droplet to assume its lowest energy spherical shape and shear-off from the orifice, the aqueous flow assumed an oblate, plug-like shape, bounded by the reduced 1 μm channel height. Under these conditions, the aqueous plug ultimately filled the entire volume of the oil channel.

The droplet formation mechanism was highly dependent on interfacial tension induced forces. When the interfacial tension was lowered with the addition of 0.1% v/v NP-PEG surfactant, which has been shown to effectively passivate the oil/water interface against nonspecific adsorption and inactivation of enzymes, a lower backing pressure was required to fill the 1:1 aspect ratio channel and form droplets, 122.1 kPa. In addition, the time interval between successive droplets increased (to about 10 seconds). This was because the time-dependent diffusion of surfactant molecules from the oil phase and their dynamic adsorption at the three-phase interface (oil/water/PDMS) in the aqueous channel became the rate-limiting steps. When the surfactant concentration was increased to 1.0% v/v, the interfacial tension was reduced enough to the point where discrete droplets could no longer be formed; instead the aqueous phase flooded the oil channel.

EXAMPLE 2

Fusion of Individual Femtoliter Droplets and Trigging of a Confined Chemical Reaction On-Demand In this example, two apposed (1 μm wide×1 μm high) microchannels fabricated in poly-dimethylsiloxane (PDMS) were designed to deliver separate droplets containing different aqueous phases into a larger center oil channel (18 μm height, with either 12 μm or 25 μm width). Fabrication details are similar to that described for the microchannel device in Example 1.

To prevent wetting of the aqueous droplets on the channel walls, PDMS replicas were bonded to PDMS-coated glass coverslips, followed by heating at 120° C. for 48 hours to ensure complete hydrophobic recovery. Shrinkage of aqueous droplets from evaporation was minimized by purifying the soybean oil used as the immiscible carrier phase to reduce surface-active contaminants, which reduces the partitioning of water into the oil. Evaporation was further reduced by saturating the PDMS chip in deionized water for at least 24 hours prior to experiments. Droplet shrinkage rates were 1 $\mu m^2$/min over the time course of a typical experiment (about an hour).

Figure 6:
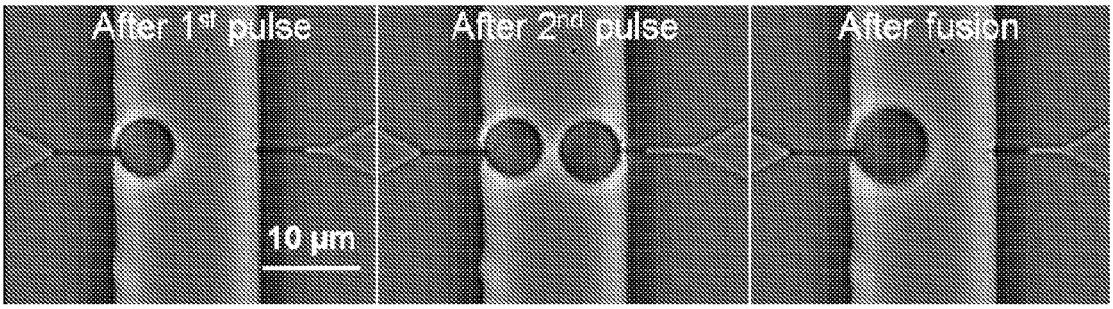
FIG. 6 includes still images captured with CCD camera of consecutive formation of droplets and fusion as described in Example 2.

On-demand generation of droplets was triggered by short (10 msec) pressure pulses with magnitudes about 5% higher than the capillary pressure necessary to fill a (1 μm×1 μm) hydrophobic PDMS microchannel with aqueous solution up to the junction with the oil channel (124–131 kPa). From bright field images of 87 droplets taken with a CoolSNAP HQ CCD camera (Roper Scientific), the droplet size distribution for devices with the 12 μm wide oil channels was 3.7±0.4 μm (from 37 images), and 5.5±0.6 μm for devices with 25 μm wide oil channels (from 50 images). Careful balancing of the hydrostatic pressure in the oil channel enabled precise positioning of the first droplet to within 1.1±0.6 μm (from 45 images) of the orifice, as shown in the first panel of FIG. 6.

In this example, droplets were ejected from either aqueous channel, and forced to collide and fuse with a droplet already formed. This process is shown in the second and third panels of FIG. 6. The magnitudes of the 10 msec pressure pulses used to eject subsequent droplets were slightly higher than those used to form the first droplet (by about 2 kPa) in order to impart additional kinetic energy to facilitate fusion and mixing. At the completion of each fusion event, the channel junction could be cleared of droplets for the next experiment by temporarily increasing the pressure in the oil channel to about 40 kPa.

Figures 7A, 7B, 7C, 7D, 7E, 7F:
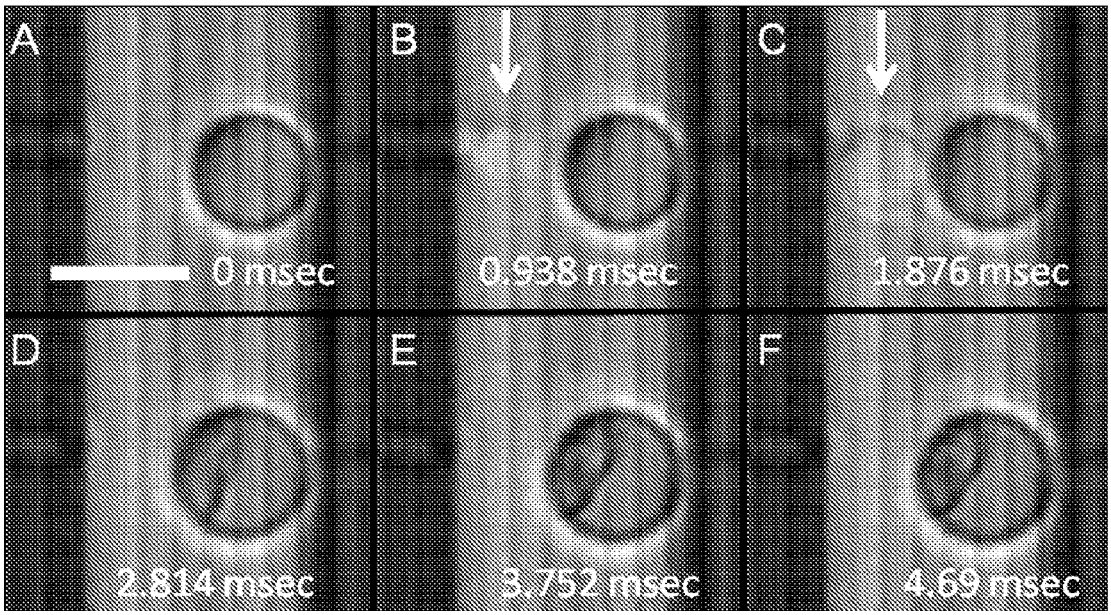
FIG. 7A-7F are still images captured with high-speed CMOS camera of fusion of initial 2M NaCl(aq) droplet with subsequent 2M $AgNO_3$(aq) droplet (arrows). Frame rate 938 μsec. Scale bar 5 μm.

FIGS. 7A-7F illustrate a sequence of bright field images from a high-speed CMOS camera (EPIX SV643) showing the formation of AgCl(s) after fusion of a droplet containing 2M NaCl(aq) with one containing $AgNO_3$(aq). The NaCl(aq) droplet detached first from the right hand side channel, as seen in FIG. 7A. In FIGS. 7B and 7C, the second $AgNO_3$(aq) droplet can be observed forming in the oil channel from the left, and colliding with the NaCl (aq) droplet before it could fully inflate and detach from its channel opening. Within the time period of one frame, FIGS. 7C-7D, corresponding to less than one msec, the $AgNO_3$(aq) droplet completely merged with the larger NaCl(aq) droplet, and formation of a gel-like film containing AgCl(s) appeared to be largely complete. The last two images in the sequence show little additional changes to the gel. The fact that the AgCl(s) product was located on only one side of the fused droplet indicates the precipitation rate was faster than any mixing time scales in the droplet. Product formation was considerably faster than the estimated diffusive mixing time, which would be on the order of 10 msec, using tmix=<x2>/2D in a 5 μm diameter product droplet as an estimate, and using the published diffusion coefficient for 2M $AgNO_3$(aq) of about 103 μm2/sec.

Figure 8:
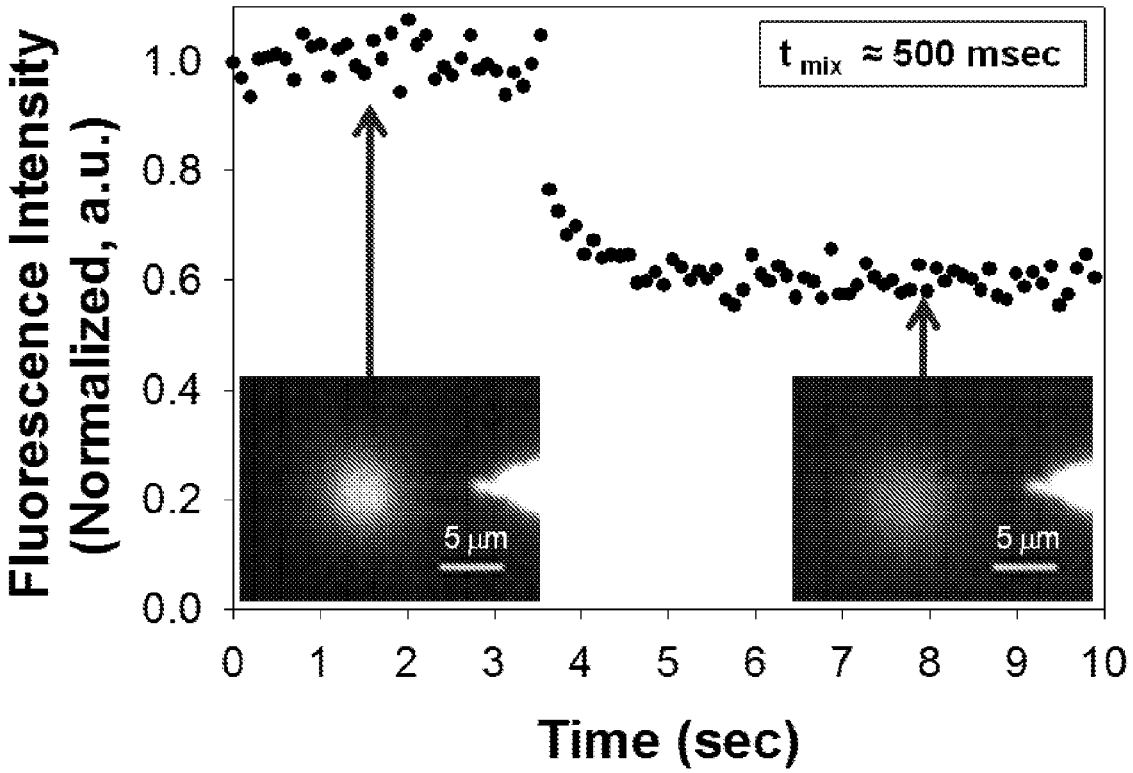
FIG. 8 is a plot showing the fluorescence intensity decrease of droplet containing 50 nm microspheres (0.4 mg/mL in phosphate buffer, pH 7.2) before (left inset) and after fusion (right inset) with droplet containing only buffer solution.

To obtain a clearer picture of the relative roles of convective versus diffusive mixing triggered by droplet fusion, the time-dependent change was measured in fluorescence from a droplet containing 50 nm diameter fluorescent polymer microspheres (FS02F/9290, Bangs Laboratories) in phosphate buffer as it merged with a droplet containing only buffer solution, shown in FIG. 8. The much slower diffusion coefficient of the microspheres, 8.4 μm2/sec, allowed one to track changes in fluorescence intensity after droplet fusion at the 100 msec frame rate of the CCD camera, comparable to diffusive mixing time scales of the beads. Droplet sizes before (left inset, 5.4±0.3 μm) and after fusion (right inset, 6.5±0.2 μm) were estimated from full width at half maxima of fluorescent intensity line profiles of images taken from movie sequences of droplet fusion captured with the CCD camera.

The time-dependent change in fluorescence due to dilution of the microspheres was determined by measuring the average intensity from a 1.7 μm×1.7 μm region located at the center of each of the fluorescent droplets. The time interval observed between the sharp decrease of the initial fluorescent intensity from the unfused droplet to one standard deviation from the mean value of the final intensity after dilution of the microspheres was 500 msec. This is about a factor of 5 faster than the tmix=<x2>/2D=2.4 sec estimate for diffusive mixing in the product droplet. As a check, the average value of the relative fluorescence intensity after droplet fusion, 61%, was close to the change in concentration of the beads estimated from the change in droplet volume before (82 fL) and after fusion (147 fL), 56%.

Figures 9A, 9B, 9C:
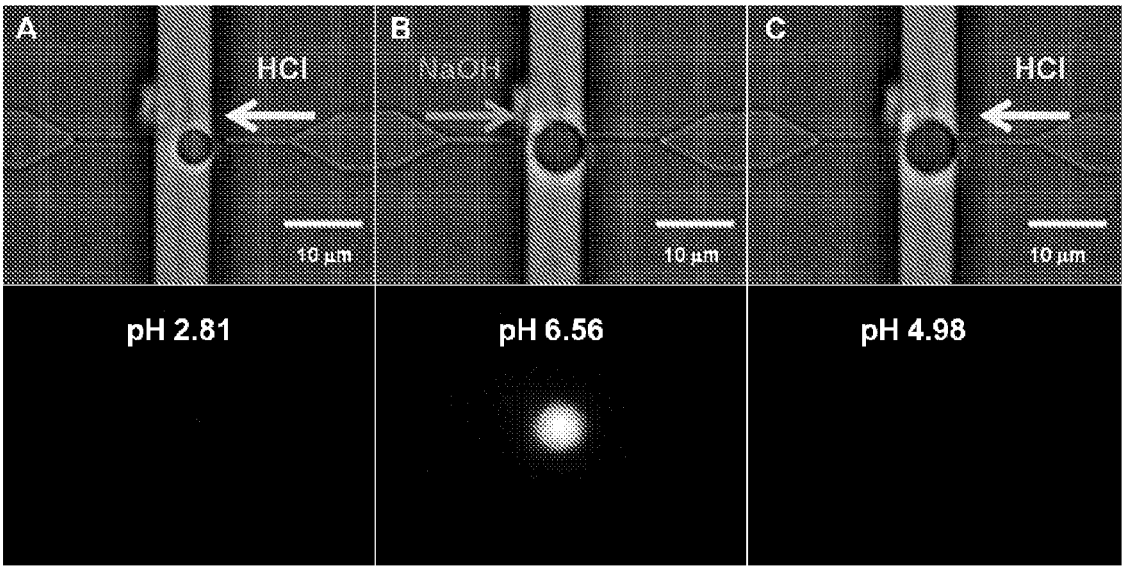
FIGS. 9A-9C illustrate the operation of reversible chemical toggle switch based on consecutive fusion of droplets containing acidic or basic solution, measured with fluorescence. Top row bright field images, bottom row corresponding fluorescence images.

FIGS. 9A-9C show how consecutive fusion operations with droplets containing acidic or basic solutions can rapidly and reversibly switch "on" and "off" the fluorescent intensity of a pH-sensitive dye. Fluorescein in aqueous solution can exist in several ionization forms, cationic, neutral, monoanionic and dianionic, resulting in absorption and fluorescence properties that depend sensitively on pH. The dianion has the strongest fluorescence intensity with a quantum yield of 0.93, while the other forms are significantly less fluorescent. The top row in FIGS. 9A-9C show still images from bright field movie sequences captured with the CCD camera of droplet generation and fusion alternating between an aqueous channel containing 10 μM fluorescein in 2 mM HCl(aq) at pH 2.81 (right hand side channel) and 2 mM NaOH(aq) at pH 11.23 (left hand side channel). The bottom row are fluorescent images displayed with the same maximum and minimum contrast values captured immediately after each corresponding bright field image in the top row.

The chemical toggle switch was initialized in FIG. 9A with the generation and localization in the oil channel of a 47 fL droplet from the fluorescein/HCl(aq) channel at pH 2.81. At this pH, an equilibrium exists between the cationic and neutral forms of fluorescein, related by the polyprotic acid dissociation constant pK1=2.08. In FIG. 9B, two 50 fL droplets of the NaOH(aq) solution from the left hand side channel fused with the acidic droplet in the oil channel, increasing its volume to 142 fL. The corresponding fluorescence image shows strong emission emanating from the fusion product. The pH in the fused droplet was estimated by mixing the fluorescein/HCl(aq) and NaOH(aq) solutions at the same volumetric ratios in the bulk as calculated from the size of the droplets, and measuring the pH with a pH meter (S20 SevenEasy, Mettler Toledo), which gave a value of 6.56. At this pH, the major equilibrium species present in the droplet were now the monoanionic and strongly fluorescent dianionic forms (pK3=6.43). Addition of another 30 fL droplet from the acidic channel in FIG. 9C decreased the pH of the switch to 4.98 (total volume of the fusion product droplet now 172 fL), corresponding to the neutral form and the monoanion (pK2=4.31), neither of which as strongly fluorescent as the dianion. The switch could be reset simply by flushing the aqueous droplet out of the oil channel, and reinitializing the sequence of droplet formation and fusion events.

While the present disclosure has been particularly shown and described with respect to preferred embodiments thereof, it will be understood by those skilled in the art that the foregoing and other changes in forms and details may be made without departing from the spirit and scope of the present disclosure. It is therefore intended that the present disclosure not be limited to the exact forms and details described and illustrated, but fall within the scope of the appended claims.

What is claimed is:

1. A microfluidic device for generation of monodisperse droplets, said microfluidic device comprising:

a first input microchannel having a first dimension and comprising a vertical portion extending upwards from a horizontal portion;

a second input microchannel having a second dimension and comprising a vertical portion extending upwards from a horizontal portion, wherein said second dimension is different from said first dimension;

a third input channel having a third dimension and comprising a vertical portion extending upwards from a horizontal portion, wherein said third dimension is different from at least the second dimension of the second input channel and wherein said third input microchannel and said second input microchannel are in communication with another microchannel junction;

a microchannel junction in communication with the first input microchannel and said second input microchannel;

an output channel in communication with said microchannel junction and set to receive a monodisperse droplet and comprising a vertical portion extending upwards from a horizontal portion, wherein the horizontal portions of said first input microchannel, said second input microchannel and said output channel meet at said microchannel junction and wherein the difference in the first dimension and the second dimension creates an interfacial tension induced force at said microchannel junction which forms said monodisperse droplet in the absence of a cross flow of an oil or any active mechanism; and wherein the droplet formed is distorted due to the steric constraint of the microchannel junction.

2. The microfluidic device of claim 1, wherein said first dimension is a first height, and said second dimension is a second height.

3. The microfluidic device of claim 1, wherein said second height is greater than said first height.

4. The microfluidic device of claim 1, wherein the difference in the third dimension and the second dimension creates another interfacial tension induced force at the another microchannel junction which forms another monodisperse droplet which fuses with the monodisperse droplet forming a fuse monodisperse droplet.

5. The microfluidic device of claim 4, wherein said second height is greater than said first height and said third height.

6. The microfluidic device of claim 4, wherein said second height is from 10 micrometers to 20 micrometers, said first height is from 0.5 micrometers to 5.0 micrometers, and said third height is from 0.5 micrometers to 5.0 micrometers.

7. The microfluidic device of claim 4, wherein said another interfacial tension induced force is formed in the absence of a cross flow of an oil or any active mechanism.

8. The microfluidic device of claim 1, wherein said third input microchannel comprises a vertical portion extending upwards from a horizontal portion.

9. A microfluidic device for generation of monodisperse droplets, said microfluidic device comprising:

a first input microchannel having a first dimension and comprising a vertical portion extending upwards from a horizontal portion;

a second input microchannel having a second dimension and comprising a vertical portion extending upwards from a horizontal portion, wherein said second dimension is different from said first dimension;

a microchannel junction in communication with the first input microchannel and said second input microchannel;

an output channel in communication with said microchannel junction and set to receive a monodisperse droplet and comprising a vertical portion extending upwards from a horizontal portion, wherein the horizontal portions of said first input microchannel, said second input microchannel and said output channel meet at said microchannel junction and wherein the difference in the first dimension and the second dimension creates an interfacial tension induced force at said microchannel junction which forms said monodisperse droplet in the absence of a cross flow of an oil or any active mechanism;

wherein said second dimension is from 10 micrometers to 20 micrometers and said first dimension is from 0.5 micrometers to 5.0 micrometers; and wherein the droplet formed is distorted due to the steric constraint of the microchannel junction.

* * * * *